US011158931B2

(12) United States Patent
Liu

(10) Patent No.: US 11,158,931 B2
(45) Date of Patent: Oct. 26, 2021

(54) TERMINAL HOUSING AND TERMINAL

(71) Applicant: BEIJING XIAOMI MOBILE SOFTWARE CO., LTD., Beijing (CN)

(72) Inventor: Yaqi Liu, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 98 days.

(21) Appl. No.: 16/232,264

(22) Filed: Dec. 26, 2018

(65) Prior Publication Data

US 2020/0106173 A1 Apr. 2, 2020

(30) Foreign Application Priority Data

Sep. 28, 2018 (CN) ..... 201811140338.1

(51) Int. Cl.

| | |
|---|---|
| ***H01Q 1/24*** | (2006.01) |
| ***H01Q 21/06*** | (2006.01) |
| ***H01Q 1/38*** | (2006.01) |
| ***H01Q 1/52*** | (2006.01) |

(52) U.S. Cl.

CPC ..... *H01Q 1/243* (2013.01); *H01Q 1/38* (2013.01); *H01Q 1/523* (2013.01); *H01Q 21/065* (2013.01)

(58) Field of Classification Search

CPC ..... H01Q 1/243; H01Q 1/38; H01Q 21/065; H01Q 1/2283; H01Q 1/40; H01Q 1/405; H01Q 1/42; H01Q 1/523; H01Q 23/00

See application file for complete search history.

(56) References Cited

U.S. PATENT DOCUMENTS

| | | | | |
|---|---|---|---|---|
| 6,470,174 | B1 | 10/2002 | Schefte et al. | |
| 9,306,268 | B2 | 4/2016 | Hwang et al. | |
| 9,547,070 | B2 | 1/2017 | Corcos et al. | |
| 10,153,544 | B2 * | 12/2018 | Zhang | H01Q 9/04 |
| 2011/0109507 | A1 * | 5/2011 | Warnick | H01Q 21/0025 342/368 |

(Continued)

FOREIGN PATENT DOCUMENTS

| | | | |
|---|---|---|---|
| CN | 107660319 | A | 2/2018 |
| CN | 206962002 | U | 2/2018 |

(Continued)

OTHER PUBLICATIONS

First Office Action issued to EP Application No. 19193923.0, dated Feb. 17, 2020, (10p).

(Continued)

*Primary Examiner* — Robert Karacsony
(74) *Attorney, Agent, or Firm* — Arch & Lake LLP

(57) ABSTRACT

The present disclosure relates to a terminal housing and a terminal. The terminal housing includes a rear cover, a radio frequency module and an antenna array. The radio frequency module is coupled to the antenna array. The rear cover includes a first area and a second area where the second area is different from the first area, and the first area is coupled to the second area through insulating material. The first area includes a plurality of antenna array elements, each of the plurality of antenna array elements is made of conductive material, and any two adjacent antenna array elements are coupled using insulating material, and the plurality of antenna array elements form the antenna array.

20 Claims, 6 Drawing Sheets

(56) References Cited

U.S. PATENT DOCUMENTS

| | | | | |
|---|---|---|---|---|
| 2013/0234910 | A1* | 9/2013 | Oh | H01Q 5/378 343/872 |
| 2014/0009355 | A1 | 1/2014 | Samardzija et al. | |
| 2015/0188210 | A1 | 7/2015 | Asrani et al. | |
| 2016/0285520 | A1 | 9/2016 | Baek et al. | |
| 2016/0302319 | A1* | 10/2016 | Ferretti | H04M 1/0202 |
| 2016/0308563 | A1* | 10/2016 | Ouyang | H01Q 21/062 |
| 2016/0351996 | A1* | 12/2016 | Ou | H01Q 21/065 |
| 2018/0006359 | A1 | 1/2018 | Wong et al. | |
| 2018/0198196 | A1* | 7/2018 | Ely | C23C 28/322 |

FOREIGN PATENT DOCUMENTS

| | | | |
|---|---|---|---|
| CN | 108281802 | A | 7/2018 |
| CN | 108376828 | A | 8/2018 |
| CN | 108448229 | A | 8/2018 |
| WO | 2013167075 | A2 | 11/2013 |

OTHER PUBLICATIONS

First Office Action issued to Chinese Patent Application No. 201811140338.1 dated Feb. 6, 2020 with English translation (13p).

Bray, M.G. et al. "Thinned Aperiodic Linear Phased Array Optimization for Reduced Grating Lobes During Scanning with Input Impedance Bounds", IEEE Antennas and Propagation Society International Symposium, Boston, MA, Jul. 8-13, 2001, pp. 688-691.

Third Office Action issued to Chinese Patent Application No. 201811140338.1 dated Apr. 23, 2021 with English translation, (16p).

* cited by examiner

TERMINAL HOUSING AND TERMINAL

CROSS-REFERENCE TO RELATED APPLICATIONS

This application is based on and claims priority to Chinese Patent Application No. 201811140338.1, filed on Sep. 28, 2018, the entire content of which is incorporated herein by reference for all purposes.

TECHNICAL FIELD

The present disclosure relates to the field of communications technologies, and more particularly, to a terminal housing and a terminal.

BACKGROUND

The antenna module is a component of the mobile terminal for transmitting or receiving wireless signals. With the continuous development of communication technologies, people require high performance for the antenna module, and the performance of the antenna module has become an important indicator for evaluating the overall performance of the terminal.

SUMMARY

The present disclosure provides a terminal housing and a terminal.

According to a first aspect, a terminal housing is provided. The terminal housing may include a rear cover, a radio frequency (RF) module and an antenna array. The RF module is coupled to the antenna array. The rear cover includes a first area and a second area where the second area is different from the first area, and the first area is coupled to the second area through insulating material. The first area includes a plurality of antenna array elements, each of the plurality of antenna array elements is made of conductive material, and any two adjacent antenna array elements are coupled using insulating material, and the plurality of antenna array elements form the antenna array.

According to a second aspect, a terminal provided. The terminal includes the terminal housing, and the terminal housing may include: a rear cover, a RF module and an antenna array. The RF module is coupled to the antenna array. The rear cover includes a first area and a second area where the second area is different from the first area, and the first area is coupled to the second area through insulating material. The first area includes a plurality of antenna array elements, each of the plurality of antenna array elements is made of conductive material, and any two adjacent antenna array elements are coupled using insulating material, and the plurality of antenna array elements form the antenna array.

It is to be understood that both the foregoing general description and the following detailed description are exemplary only and are not restrictive of the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will be made in detail to examples of the present disclosure. The examples described herein with reference to drawings are explanatory, illustrative, and used to generally understand the present disclosure.

The terminology used in the present disclosure is for the purpose of describing particular examples only and is not intended to limit the present disclosure. As used in this disclosure and the appended claims, the singular forms "a", "an", and "the" are intended to include the plural forms as well, unless the context clearly indicates otherwise. It should also be understood that the term "and/or" as used herein refers to and includes any and all possible combinations of one or more of the associated listed items.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Sometimes, the terminal includes a housing, a display screen, a circuit board and an antenna module disposed on the circuit board. The housing includes a side frame and a rear cover. The display screen, the side frame and the rear cover form the external surface of the terminal. The circuit board and the antenna module are located inside the housing. The antenna module includes a radio frequency (RF) module and an antenna array, and the antenna array is parallel to the display screen. ARF port of the RF module is coupled to the antenna array through the feeder, which can control the signal transmission and reception of the antenna array.

Since the display screen located in front of the antenna module is made of metal material, sometimes, the rear cover located behind the antenna module can only be made of non-metal material to avoid shielding the signal of the antenna module, resulting in strict restrictions.

Figure 1:
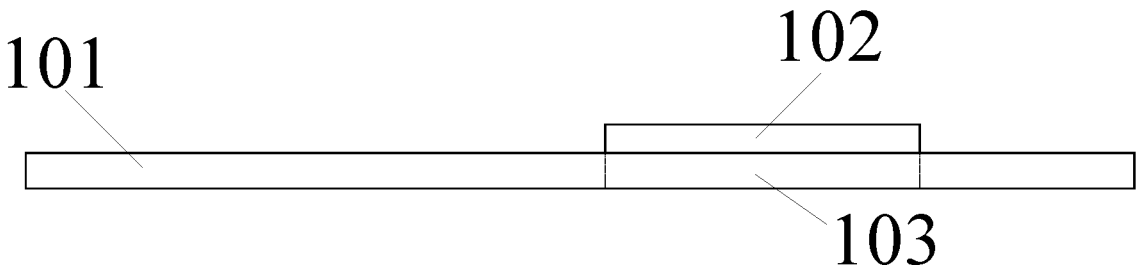
FIG. 1 is a schematic diagram illustrating a side view of a terminal housing according to an example.
Figure 2:
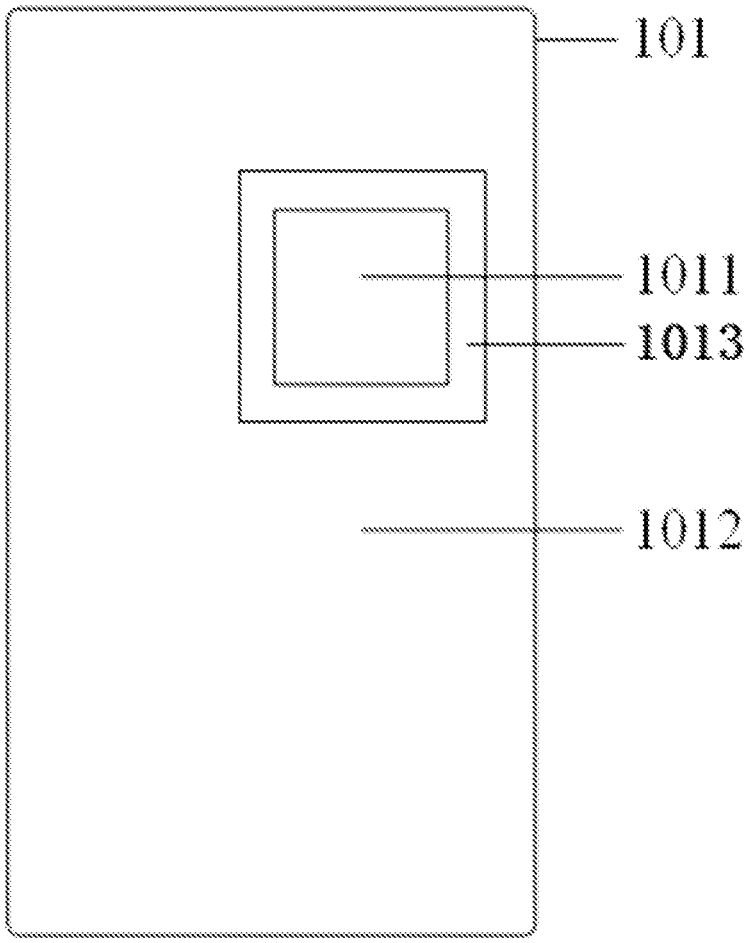
FIG. 2 is a schematic diagram illustrating a rear view of a terminal housing according to an example.
Figure 3:
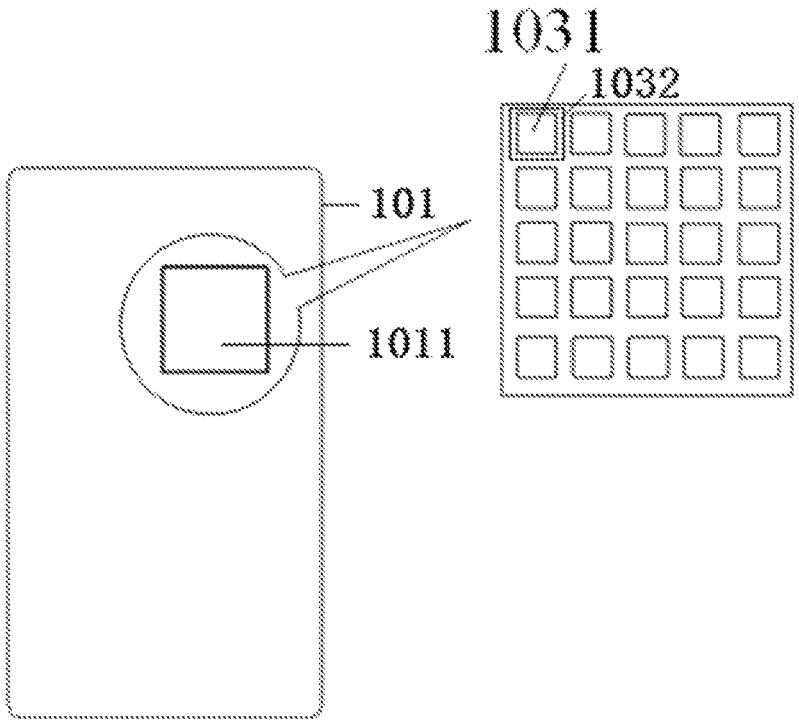
FIG. 3 is a schematic diagram illustrating a terminal housing according to an example.

FIG. 1 is a schematic diagram illustrating a side view of a terminal housing according to an example. FIG. 2 is a schematic diagram illustrating a rear view of a terminal housing according to an example. FIG. 3 is a schematic diagram illustrating a terminal housing according to an example. As illustrated in FIG. 1, FIG. 2 and FIG. 3, the terminal housing includes a rear cover 101, a RF module 102 and an antenna array 103.

The RF module 102 may be a WIFI (Wireless Fidelity) module, a Bluetooth module, or any module configured to control signal transceiving of the terminal. The RF module 102 is electrically coupled to the antenna array 103, so as to transmit or receive signals through the antenna array 103.

As shown in FIG. 2, the rear cover 101 includes a first area 1011 and a second area 1012 other than the first area 1011. The first area 1011 is connected to the second area 1012 through a first insulating material 1013. As shown in FIG. 3, the first area 1011 includes a plurality of antenna array elements 1031, each of the plurality of antenna array elements 1031 is made of conductive material, and any two adjacent antenna array elements 1031 are coupled through a second insulating material 1032, such that the plurality of antenna array elements 1031 form the antenna array 103. Each antenna array element 1031 serves as a radiator of the antenna array 103.

In the operating process of the antenna array 103, signals generated by the RF module 102 are transmitted to the plurality of antenna array elements 1031 in the antenna array 103, and the signals are transmitted by the plurality of antenna array elements 1031. And, in the process of transmitting the signal, the signals of the plurality of antenna array elements 1031 are combined to form a beam, directivity and signal strength of the radiation field can be enhanced. Alternatively, the plurality of antenna array elements 1031 perform scanning, receive signals and transmit the signals to the RF module 102, the scanning range can be increased.

The plurality of antenna array elements 1031 form the antenna array 103, and the signals are transmitted and received by the antenna array 103, such that the signal radiation direction of the antenna array 103 can be more concentrated, the radiation energy of the signal in the radiation direction can be larger, and the signal transceiving capability of the antenna array 103 can be improved.

In a possible implementation, the antenna array 103 may be a phased array antenna. In the operating process, by changing the phase of the RF module 102, signal synthesizing and scanning of the antenna array 103 can be achieved. Alternatively, the antenna array 103 may also be other types of antennas.

With the terminal housing according to examples of the present disclosure, the first area where the antenna array is located is coupled to the second area through insulating material, the first area includes a plurality of antenna array elements, each of the plurality of antenna array elements is made of conductive material, and any two adjacent antenna array elements are coupled through insulating material, such that the plurality of antenna array elements form the antenna array. The RF module is coupled to the antenna array, such that a channel for receiving and transmitting signals is formed. When the rear cover is made of the metal material, the antenna array on the rear cover can directly receive and transmit signals, which can prevent the metal rear cover from blocking or shielding the signal of the antenna array, performance of the antenna array can be ensured, and when the rear cover is made of the non-metal material, the performance of the antenna array can be further improved. Therefore, the antenna array according to examples of the present disclosure can be applied to the rear cover made of the metal material or the non-metal material, the application range is wider, and flexibility can be improved.

Figure 4:
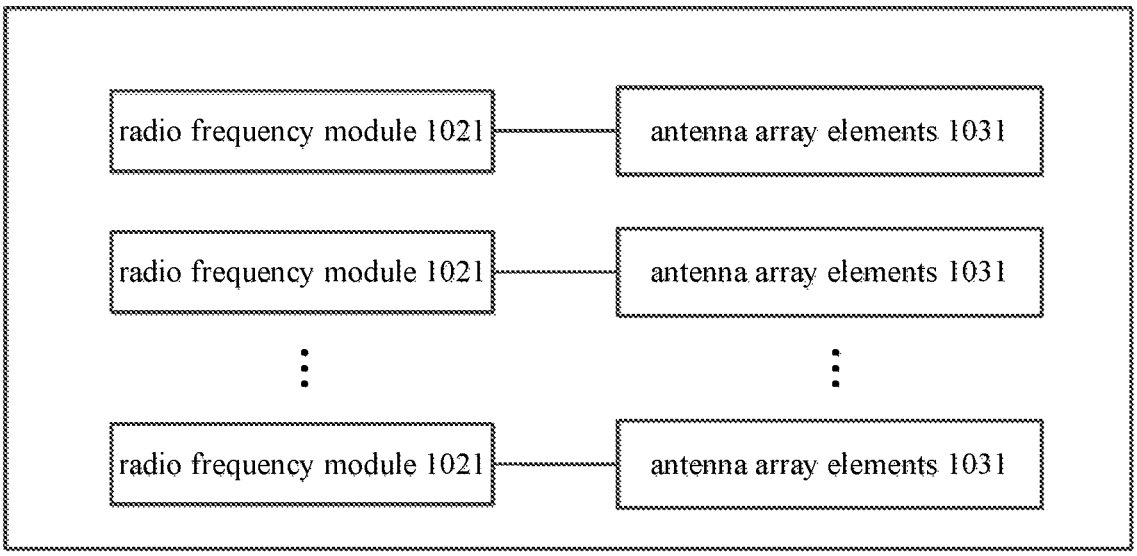
FIG. 4 is a schematic diagram illustrating an antenna module according to an example.

FIG. 4 is a schematic diagram illustrating an antenna module according to an example. As illustrated in FIG. 4, the antenna module includes the RF module 102 and the antenna array 103. The RF module 102 includes a plurality of RF units 1021. The antenna array 103 includes a plurality of antenna array elements 1031. The number of the plurality of RF units 1021 is equal to the number of the plurality of antenna array elements 1031, and each RF unit 1021 is electrically connected to a corresponding antenna array element 1031.

In the operating process of the antenna module, the signal generated by the RF unit 1021 is transmitted to the corresponding antenna array element 1031, and the signal is transmitted by the antenna array element 1031, or the signal is received by the antenna array element 1031, and is transmitted to the corresponding RF unit 1021, so as to implement signal transmission and reception.

In the process of signal transmission, after the antenna array element 1031 receives the signal transmitted by the corresponding RF unit 1021, the antenna array element 1031 transmits the signal outward, and the signals of the plurality of antenna array elements 1031 are combined to form a beam, the beam is radiated toward the rear side of the rear cover 101, which can make the radiation direction of the signal more intensive, and can enhance the directivity of the radiation field and the signal intensity in the radiation direction.

For example, when the antenna module transmits the signal outward, each of the plurality of RF units 1021 respectively transmits the signal to the corresponding antenna array element 1031, the signals of the plurality of antenna array elements 1031 are synthesized to form a beam, the beam is radiated outward along the synthesizing direction, such that the signal strength in the synthesizing direction can be enhanced. When the antenna module receives the signal, the plurality of antenna array elements 1031 respectively scan in their respective scanning angle ranges, receive the scanned signals, and transmit the received signals to the corresponding RF units 1021 respectively, so as to realize signal reception of the antenna module.

In a possible implementation, each RF unit 1021 is coupled to an inner side of the corresponding antenna array element 1031 through probe to form a microstrip antenna, a plurality of microstrip antennas can be formed, and each of the plurality of the microstrip antennas can receive and transmit the signal separately.

Each probe is in contact with the corresponding antenna array element 1031 at a certain position, and a contact point is formed in the corresponding antenna array element 1031, when the plurality of RF units 1021 are respectively coupled to the inner side of their corresponding antenna array elements 1031, a plurality of contact points can be formed. Since the RF unit 1021 provides the signal to the antenna array element 1031 via the probe, the contact point between the probe and the antenna array element 1031 is also referred to as a feed point.

In another possible implementation, each RF unit 1021 is coupled to the inner side of the corresponding antenna array element 1031 through welding to form a microstrip antenna, a plurality of microstrip antennas can be formed, and each of the plurality of the microstrip antennas can receive and transmit the signal separately.

In the welding manner, a contact point can be formed in the corresponding antenna array element 1031, and when the plurality of RF units 1021 are coupled to the inner side of their corresponding antenna array elements 1031 through welding, a plurality of contact points can be formed. Since the RF unit 1021 provides the signal to the antenna array element 1031 via the contact point, the contact point is also referred to as a feed point.

Figure 5:
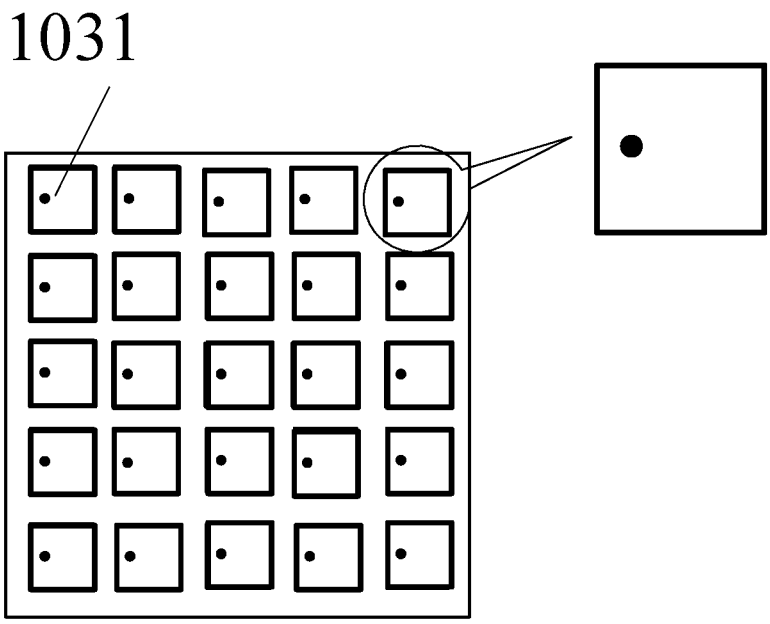
FIG. 5 is a schematic diagram illustrating an antenna array element and a feed point according to an example.

In the above two possible implementations, as shown in FIG. 5, the feed point has the same position in each antenna array element 1031. For example, in each antenna array element 1031, the feed point may be located on the horizontal central axis near the left edge (as illustrated in FIG. 5), the horizontal central axis near the right edge, the vertical central axis near the lower edge, or the like. In this way, it can be ensured that the signals transmitted by the antenna array 103 formed by the plurality of antenna array elements 1031 are uniformly radiated in all directions, the performance of the antenna array 103 can be improved.

With the terminal housing according to examples of the present disclosure, each RF module includes a plurality of RF units, each RF unit is electrically coupled to the corresponding antenna array element, and the feed point is in the same position on the corresponding antenna array element, such that the performance of the microstrip antenna formed by the RF unit being electrically coupled to the antenna array element can be consistent, uniform radiation in all directions can be realized, the performance of the antenna array can be improved.

In an example of the present disclosure, the first area 1011 is square, and each antenna array element 1031 has a square structure.

There may be a plurality of antenna array elements 1031 arranged in the first area 1011, and the plurality of antenna array elements 1031 are arranged at equal intervals in a horizontal direction and a vertical direction, to form a matrix structure. Each of the plurality of antenna array elements has the same size.

In a possible implementation, a side length of each antenna array element 1031 in the horizontal direction is equal to that in the vertical direction, i.e., each antenna array element 1031 is square. Alternatively, the side length of each antenna array element 1031 in the horizontal direction is not equal to that in the vertical direction, that is, each antenna array element 1031 is rectangular.

In another possible implementation manner, a side length of the first area 1011 in the horizontal direction is equal to the side length of the first area 1011 in the vertical direction, i.e., the first area 1011 is square. Alternatively, the side length of the first area 1011 in the horizontal direction is not equal to the side length of the first area 1011 in the vertical direction, that is, the first area 1011 is rectangle.

In another possible implementation, in the above matrix structure of the first area 1011, the number of antenna array elements 1031 in the horizontal direction is equal to the number of antenna array elements 1031 in the vertical direction. Alternatively, in the above matrix structure of the first area 1011, the number of antenna array elements 1031 in the horizontal direction is not equal to the number of antenna array elements 1031 in the vertical direction.

Figure 6:
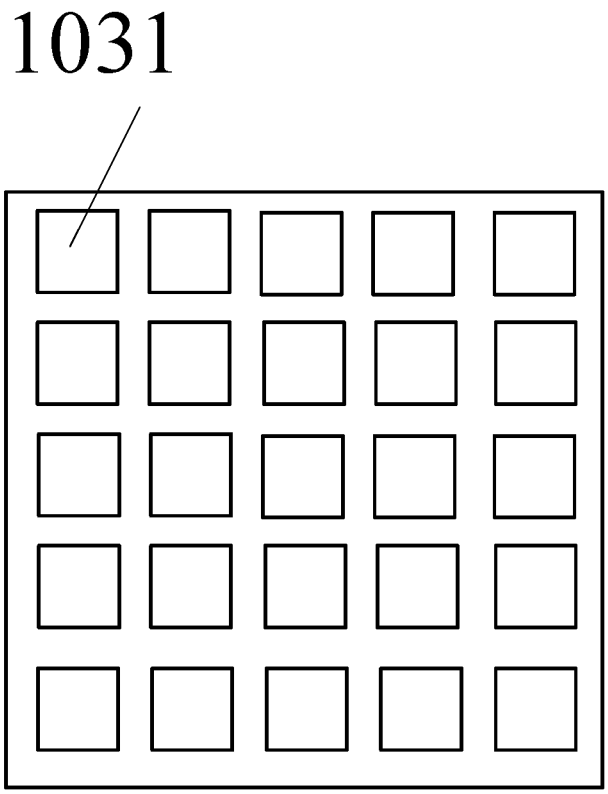
FIG. 6 is a schematic diagram illustrating an antenna array element arrangement of an antenna array according to an example.
Figure 7:
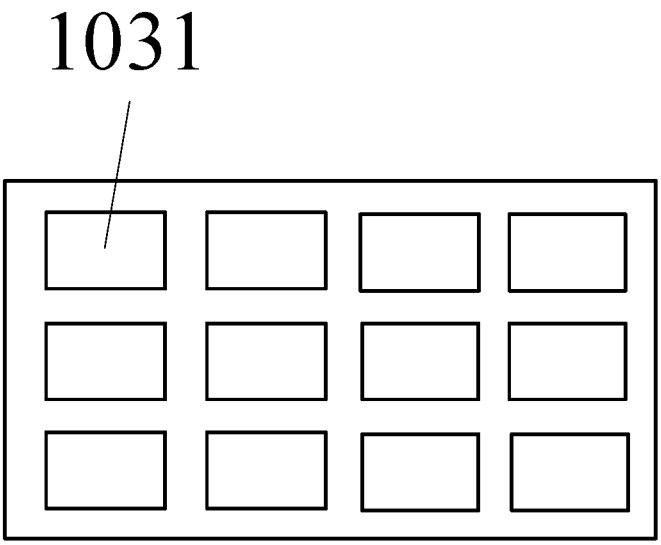
FIG. 7 is a schematic diagram illustrating an antenna array element arrangement of an antenna array according to another example.

For example, as illustrated in FIG. 6, each antenna array element 1031 is square, and the antenna array elements in the antenna array 103 are arranged in a 5×5 form, in other words, in the antenna array 103, there are 5 antenna array elements 1031 in the horizontal direction, and there are also 5 antenna array elements 1031 in the vertical direction. Alternatively, as shown in FIG. 7, each antenna array element 1031 is rectangular, and the antenna array elements in the antenna array 103 are arranged in a 3×4 form, that is, in the antenna array 103, the number of antenna array elements 1031 in the horizontal direction is 4, and the number of antenna array elements 1031 in the vertical direction is 3.

By adopting different array arrangement, the performance of the antenna array may also be different. In actual cases, the array arrangement of the antenna array 103 can be determined based on requirements of signal transmission and reception.

With the terminal housing according to examples of the present disclosure, the plurality of antenna array elements are freely combined to form the antenna array having the matrix structure, any two antenna array elements in the antenna array have the same size, and in the matrix structure of the antenna array, the number of antenna array elements in the horizontal direction may be or may not be equal to the number of antenna array elements in the vertical direction, such that the array arrangement of the antenna array can have a high degree of freedom. In the case where the number of antenna array elements in the horizontal direction is equal to the number of antenna array elements in the vertical direction, the performance of the antenna array in the horizontal direction may be consistent with the performance of the antenna array in the vertical direction, the signal radiation can be uniform in all directions, the performance of the antenna array can be improved. And, when the microstrip antenna formed by the plurality of RF units and the plurality of antenna array elements transmits the signal, the signal in all directions can be superimposed, and the radiation intensity of the signal can be enhanced, such that the performance of the antenna array can be more stable.

Figure 8:
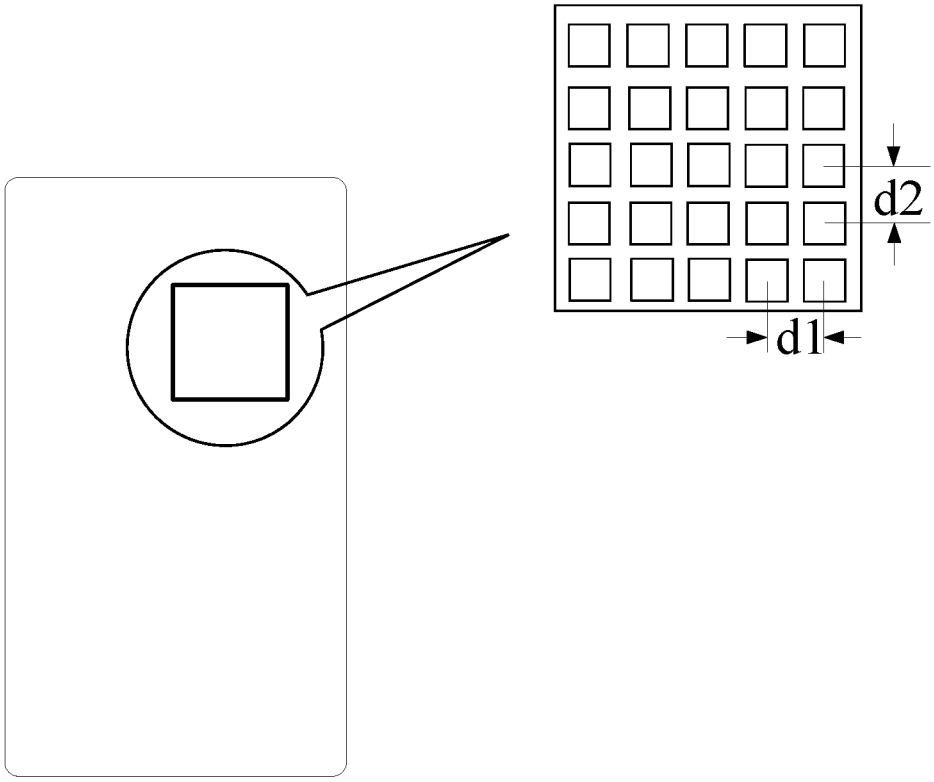
FIG. 8 is a schematic diagram illustrating a center distance of an antenna array according to an example.

FIG. 8 is a schematic diagram illustrating a center distance of an antenna array according to an example. As illustrated in FIG. 8, in a possible implementation, in the plurality of antenna array elements 1031, a distance d1 between centers of any two adjacent antenna array elements 1031 in the horizontal direction satisfies a first preset condition, and a distance d2 between centers of any two adjacent antenna array elements 1031 in the vertical direction satisfies the first preset condition.

In another possible implementation, in the plurality of antenna array elements 1031, a distance d1 between centers of any two adjacent antenna array elements 1031 in the horizontal direction satisfies a first preset condition, or a distance d2 between centers of any two adjacent antenna array elements 1031 in the vertical direction satisfies the first preset condition.

In the above two implementations, the first preset condition is $d \leq \lambda/(1+\sin(\theta))$, where d is the distance d1 or d2, $\lambda$ is an operating wavelength of the antenna array 103, and $\theta$ is a maximum scanning angle of the antenna array 103. The operating wavelength refers to the wavelength of the antenna array 103 when the antenna array 103 operates normally, and the operating wavelength corresponds to the frequency of the antenna array 103 when the antenna array 103 operates normally. The maximum scanning angle of the antenna array 103 is the largest angle of the scanning angles in all directions when the antenna array 103 transmits and receives signals.

When the distance d1 or d2 is too large, grating lobe will be generated when the antenna array 103 receives or transmits the signal, loss of signal energy will be caused, and the operating frequency of the antenna array 103 will be affected, such that the antenna array 103 cannot work in the correct frequency band. By setting the distance d1 or d2 satisfying the above-mentioned first preset condition, the loss of signal energy due to the grating lobe can be avoided, and it can be ensured that the antenna array 103 operates in the correct frequency band.

In at least one example, the antenna array 103 may operate in the fourth generation mobile communication technology (4G), the fifth generation mobile communication technology (5G) or other operating frequency bands specified by communication technologies. For example, the antenna array 103 can operate in a frequency band of 40 GHz to 70 GHz, such that 5G antenna module is formed.

Figure 9:
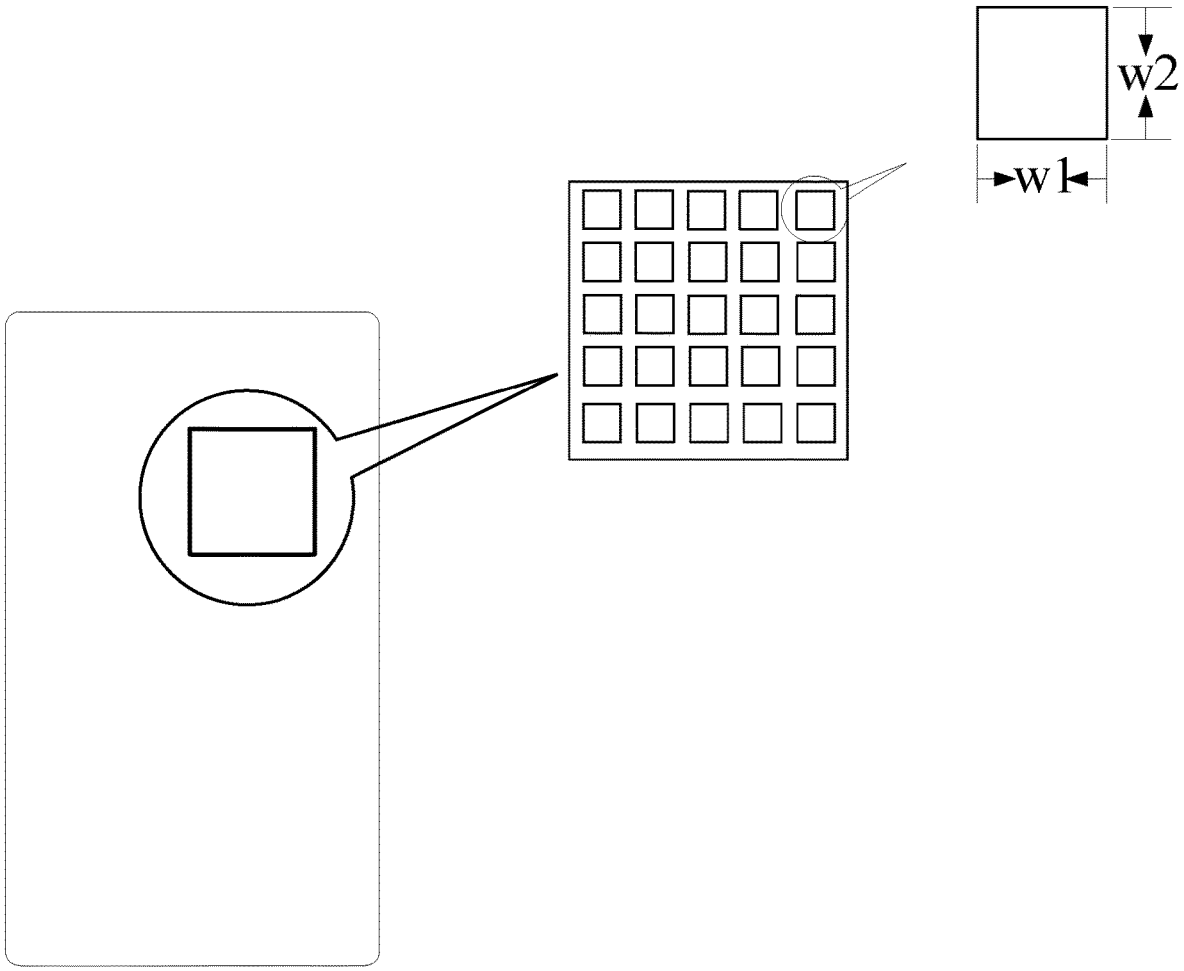
FIG. 9 is a schematic diagram illustrating a side length of an antenna array according to an example.

FIG. 9 is a schematic diagram illustrating a side length of an antenna array according to an example. As illustrated in FIG. 9, in a possible implementation, a side length w1 of each antenna array element 1031 in the horizontal direction satisfies a second preset condition, and a side length w2 of each antenna array element 1031 in the vertical direction also satisfies the second preset condition.

In another possible implementation, the side length w1 of each antenna array element 1031 in the horizontal direction satisfies a second preset condition, or a side length w2 of each antenna array element 1031 in the vertical direction also satisfies the second preset condition.

In the above two implementations, the second preset condition is $90\% \times \lambda/2 \leq w \leq 110\% \times \lambda/2$, where w is the side length w1 or w2, and $\lambda$ is the operating wavelength of the antenna array 103.

When the above-mentioned side length w1 or w2 is too long or too short, the operating frequency of the antenna array 103 will be affected, such that the antenna array 103 cannot operate in the correct frequency band. By setting the side length w1 or w2 satisfying the above second preset condition, it can be ensured that the antenna array 103 operates in the correct frequency band, and the performance of the antenna array can be more stable.

In an example of the present disclosure, the rear cover 101 is made of metal material, and the insulting material of the rear cover 101 is formed on the rear cover 101 by an injection molding process.

For example, the rear cover 101 is made of the metal material, and an injection molded strip is formed on the rear cover 101 by the injection molding process, to separate the rear cover 101 into the first area 1011 and the second area 1012. The injection molded strip is made of the first insulating material 1013, such that the first area 1011 and the second area 1012 can be insulated and disconnected. Further, a plurality of injection molded strips are formed in the first area 1011 by the injection molding process, to separate the first area 1011 into a plurality of antenna array elements 1031, and the antenna array 103 formed by the plurality of antenna array elements 1031 can be obtained. The injection molded strip is made of the second insulating material 1032, the plurality of antenna array elements 1031 can be insulated and disconnected.

In at least one example, the above insulating material may be low density polyethylene, high density polyethylene, polypropylene or other insulating material.

With the terminal housing provided by examples of the present disclosure, the rear cover is made of the metal material, and the insulating material is formed on the rear cover by the injection molding process to form the antenna array, such that the signal transmission and reception of the antenna array will not be blocked or shielded by the metal rear cover, the performance of the antenna array can be ensured, and the application range can be wider.

Figure 10:
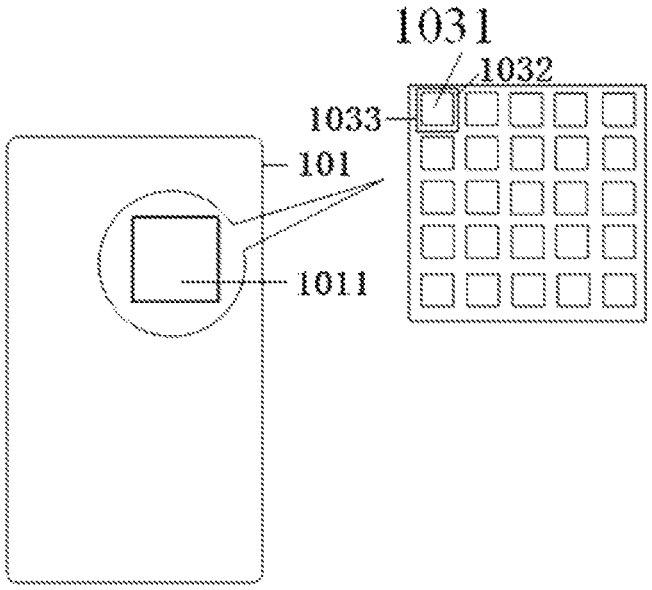
FIG. 10 is a schematic diagram illustrating a structure of the rear cover with through holes according to an example.

In another example of the present disclosure, the rear cover 101 is made of the insulating material, and as shown in FIG. 10, rear cover 101 is provided with a plurality of through holes 1033. Each antenna array element 1031 is located in a corresponding through hole 1033 on the rear cover 101 and is coupled to the inner side of the through hole by the injection molding process. The number of the plurality of through holes 1033 is equal to the number of the plurality of antenna array elements 1031.

For example, the rear cover 101 is made of non-metal material, the rear cover 101 is provided with a plurality of through holes 1033, each conductive material for forming the antenna array element 1031 is placed in the corresponding through hole 1033, and the injection molding strip 1032 is formed on the inner side of the through hole 1033 by the injection molding process, such that each conductive material is connected to the inner side of the corresponding through hole 1033 through the injection molding strip 1032 to form the antenna array element 1031, and the plurality of antenna array elements 1031 in the plurality of through holes form the antenna array 103. The non-metal material may be plastic, glass or other material.

With the terminal housing provided by examples of the present disclosure, when the rear cover is made of the non-metal material, the antenna array element is formed in the through hole on the rear cover by the injection molding process, the plurality of antenna array elements on the rear cover form the antenna array, after the antenna array element is electrically coupled to the RF unit, the antenna array element can directly transmit and receive the signal, thereby preventing the signal transmission and reception of the antenna array from being covered by the rear cover, the signal energy loss caused by the non-metal rear cover can be effectively reduced, and the performance of the antenna array can be further improved.

As described above, with the terminal housing according to examples of the present disclosure, a design solution of the antenna array is proposed. The rear cover of the terminal housing is provided with a first area, the first area is provided with a plurality of antenna array elements, and the plurality of antenna array elements are coupled together through insulating material to form the antenna array.

The antenna array is coupled to the second area of the rear cover other than the first area through insulating material, the RF module includes a plurality of RF units, and each of the plurality of RF units is electrically coupled to the corresponding antenna array element, such that the transmitted or received signals can be transmitted. The antenna array is located on the terminal housing, and is not covered by the rear cover, such that signals can be directly received and transmitted, signal blocking and shielding of the antenna array due to the rear cover made of the metal material can be avoided, and performance of the antenna array can be ensured. Moreover, when the rear cover is made of the non-metal material, signal energy loss caused by the non-metal rear cover can be effectively reduced, and signal transceiver performance of the antenna array can be further improved. Therefore, the antenna array according to examples of the present disclosure can be applied to the rear cover made of the metal material or the non-metal material, limitations that the rear cover can only be made of the non-metal material can be overcome, the application range can be extended, flexibility can be improved.

Examples of the present disclosure further provide a terminal. The terminal includes the terminal housing provided by the foregoing examples, and includes all the structures and functions of the terminal housing. Certainly, the terminal may further include a display screen, a front cover, a main board and other electronic components (such as a speaker and a microphone) in the terminal. The antenna unit formed in the terminal housing can be cooperated with other electronic components in the terminal, to implement the communication function of the terminal. The specific composition of the terminal is not limited in present disclosure.

In the terminal, the antenna array can be configured at different positions. Since the plurality of antenna array elements need to perform signal synthesis, the plurality of antenna array elements should be regularly placed, based on the position of the antenna array in the terminal, it can be divided into AoB (Antenna on Board), AiP (Antenna in Package), and AiM (Antenna in Module), and the like.

Moreover, the antenna array and the RF module are integrated in one module to arrange on the main board of the terminal, and the array of the antenna array is parallel to the display screen.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

Other examples of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. A terminal housing, comprising:

a rear cover;

a radio frequency module; and an antenna array, wherein the radio frequency module is coupled to the antenna array, wherein the rear cover comprises a first area and a second area, wherein the second area is different from the first area, and the first area is coupled to the second area through a first insulating material, wherein the first area comprises a plurality of antenna array elements, each of the plurality of antenna array elements is made of conductive material, and any two adjacent antenna array elements are coupled using a second insulating material, and the plurality of antenna array elements form the antenna array, wherein the antenna array is located on the terminal housing and is formed on the rear cover to directly receive and transmit signals, wherein the first insulating material is formed on the rear cover to separate the rear cover into the first area and the second area, and the first area and the second area are insulated and disconnected via the first insulating material, wherein the second insulating material is formed in the first area of the rear cover, to separate the first area into a plurality of antenna array elements, and the plurality of antenna array elements are insulated and disconnected via the second insulating material.

2. The terminal housing according to claim 1, wherein:

the radio frequency module comprises a plurality of radio frequency units, a number of the plurality of radio frequency units is equal to a number of the plurality of antenna array elements, and each radio frequency unit is electrically coupled to a corresponding antenna array element.

3. The terminal housing according to claim 2, wherein:

each radio frequency unit is coupled to an inner side of the corresponding antenna array element through a probe; or each radio frequency unit is coupled to an inner side of the corresponding antenna array element through welding.

4. The terminal housing according to claim 2, wherein each of the plurality of antenna array elements has a same location to be in contact with the corresponding radio frequency unit.

5. The terminal housing according to claim 1, wherein:

the first area is square, and each antenna array element has a square structure; and the plurality of antenna array elements in the first area are arranged at equal intervals in a horizontal direction and a vertical direction, to form a matrix structure.

6. The terminal housing according to claim 5, wherein each antenna array element has a same size.

7. The terminal housing according to claim 5, wherein a number of antenna array elements in the horizontal direction is equal to a number of antenna array elements in the vertical direction in the first area.

8. The terminal housing according to claim 5, wherein in the plurality of antenna array elements:

a distance between centers of any two adjacent antenna array elements in the horizontal direction satisfies a first preset condition; or a distance between centers of any two adjacent antenna array elements in the vertical direction satisfies the first preset condition, and wherein the first preset condition is $d \leq \lambda/(1+\sin(\theta))$, where d is the distance, $\lambda$ is an operating wavelength of the antenna array, and 0 is a maximum scanning angle of the antenna array.

9. The terminal housing according to claim 5, wherein:

a side length of each antenna array element in the horizontal direction satisfies a second preset condition; and/or a side length of each antenna array element in the vertical direction satisfies the second preset condition, and wherein the second preset condition is $90\% \times \lambda/2 \leq w \leq 110\% \times \lambda/2$, where w is the side length, and $\lambda$ is an operating wavelength of the antenna array.

10. The terminal housing according to claim 1, wherein:

the rear cover is made of metal material, and the first and second insulating materials are formed on the rear cover by an injection molding process; or the rear cover is made of the insulating material, the rear cover is provided with a plurality of through holes, each antenna array element is located in a corresponding through hole on the rear cover and is coupled to an inner side of the through hole by the injection molding process.

11. A terminal, comprising a terminal housing, wherein the terminal housing comprises:

a radio frequency module; and an antenna array, wherein the radio frequency module is coupled to the antenna array, wherein the rear cover comprises a first area and a second area wherein the second area is different from the first area, and the first area is coupled to the second area through a first insulating material, wherein the first area comprises a plurality of antenna array elements, each of the plurality of antenna array elements is made of conductive material, and any two adjacent antenna array elements are coupled using a second insulating material, and the plurality of antenna array elements form the antenna array, wherein the antenna array is located on the terminal housing and is formed on the rear cover to directly receive and transmit signals, wherein the first insulating material is formed on the rear cover to separate the rear cover into a first area and a second area, and the first area and the second area are insulated and disconnected via the first insulating material, wherein the second insulating material is formed in the first area of the rear cover, to separate the first area into a plurality of antenna array elements, and wherein the plurality of antenna array elements are insulated and disconnected via the second insulating material.

12. The terminal according to claim 11, wherein:

the radio frequency module comprises a plurality of radio frequency units, a number of the plurality of radio frequency units is equal to a number of the plurality of antenna array elements, and each radio frequency unit is electrically coupled to a corresponding antenna array element.

13. The terminal according to claim 12, wherein:

each radio frequency unit is coupled to an inner side of the corresponding antenna array element through a probe; or each radio frequency unit is coupled to an inner side of the corresponding antenna array element through welding.

14. The terminal according to claim 12, wherein each of the plurality of antenna array elements is has a same location to be in contact with the corresponding radio frequency unit.

15. The terminal according to claim 11, wherein:

the first area is square, and each antenna array element has a square structure; and the plurality of antenna array elements in the first area are arranged at equal intervals in a horizontal direction and a vertical direction, to form a matrix structure.

16. The terminal according to claim 15, wherein each antenna array element has a same size.

17. The terminal according to claim 15, wherein a number of antenna array elements in the horizontal direction is equal to a number of antenna array elements in the vertical direction in the first area.

18. The terminal according to claim 15, wherein in the plurality of antenna array elements:

a distance between centers of any two adjacent antenna array elements in the horizontal direction satisfies a first preset condition; or a distance between centers of any two adjacent antenna array elements in the vertical direction satisfies the first preset condition, and wherein the first preset condition is $d \leq \lambda/(1+\sin(\theta))$, where d is the distance, $\lambda$ is an operating wavelength of the antenna array, and 0 is a maximum scanning angle of the antenna array.

19. The terminal according to claim 15, wherein:

a side length of each antenna array element in the horizontal direction satisfies a second preset condition; and/or a side length of each antenna array element in the vertical direction satisfies the second preset condition, and wherein the second preset condition is $90\% \times \lambda/2 \leq w \leq 110\% \times \lambda/2$, where w is the side length, and $\lambda$ is an operating wavelength of the antenna array.

20. The terminal according to claim 11, wherein:

the rear cover is made of metal material, and the first and second insulating material are formed on the rear cover by an injection molding process; or the rear cover is made of the insulating material, the rear cover is provided with a plurality of through holes, each antenna array element is located in a corresponding through hole on the rear cover and is coupled to an inner side of the through hole by the injection molding process.

* * * * *